US011011336B2

(12) United States Patent
Yuan et al.

(10) Patent No.: US 11,011,336 B2
(45) Date of Patent: May 18, 2021

(54) DIRECT-ACTING ELECTROMAGNETIC TRIP DEVICE

(71) Applicants: ZHEJIANG CHINT ELECTRICS CO., LTD., Zhejiang (CN); SEARI ELECTRIC TECHNOLOGY CO., LTD., Shanghai (CN)

(72) Inventors: Xiaoqin Yuan, Shanghai (CN); Denggui Ao, Shanghai (CN); Fang Tang, Shanghai (CN)

(73) Assignees: ZHEJIANG CHINT ELECTRICS CO., LTD., Zhejiang (CN); SEARI ELECTRIC TECHNOLOGY CO., LTD., Shanghai (CN)

( * ) Notice: Subject to any disclaimer, the term of this patent is extended or adjusted under 35 U.S.C. 154(b) by 240 days.

(21) Appl. No.: 16/311,212

(22) PCT Filed: Aug. 10, 2017

(86) PCT No.: PCT/CN2017/096757
§ 371 (c)(1),
(2) Date: Dec. 19, 2018

(87) PCT Pub. No.: WO2018/033010
PCT Pub. Date: Feb. 22, 2018

(65) Prior Publication Data

US 2019/0189380 A1 Jun. 20, 2019

(30) Foreign Application Priority Data

Aug. 15, 2016 (CN) ..... 201610668166.X

(51) Int. Cl.
*H01H 75/00* (2006.01)
*H01H 71/74* (2006.01)
(Continued)

(52) U.S. Cl.
CPC ..... *H01H 71/7463* (2013.01); *H01H 71/24* (2013.01); *H01H 71/2454* (2013.01); *H01H 71/34* (2013.01); *H01H 71/74* (2013.01)

(58) Field of Classification Search
CPC .... H01H 71/24; H01H 71/2454; H01H 71/34; H01H 71/74; H01H 71/7463
(Continued)

(56) References Cited

U.S. PATENT DOCUMENTS 3,391,361 A * 7/1968 Jencks ..... H01H 71/7463 335/176
3,484,728 A * 12/1969 Shaffer ..... H01F 7/08 335/176
(Continued)

FOREIGN PATENT DOCUMENTS

CN 104124114 A 10/2014
CN 104637747 A 5/2015
(Continued)

OTHER PUBLICATIONS

International Search Report dated Nov. 16, 2017 in corresponding PCT International Application No. PCT/CN2017/096757.
(Continued)

*Primary Examiner* — Shawki S Ismail
*Assistant Examiner* — Lisa N Homza
(74) *Attorney, Agent, or Firm* — Ostrolenk Faber LLP

(57) ABSTRACT

A direct-acting electromagnetic trip device including a housing, and a regulation mechanism, a linkage mechanism, an electromagnetic system and a trip mechanism which are arranged in the housing. The regulation mechanism is connected with the linkage mechanism, the linkage mechanism is connected with one end of an iron core of the electromagnetic system, and the linkage mechanism is connected with the trip mechanism at the same time. The regulation
(Continued)

mechanism includes a rotary knob and a regulation rod, wherein the rotary knob is abutted against and engaged with the regulation rod, and the regulation rod is abutted against and engaged with the linkage mechanism. The electromagnetic system further includes an elastic element that pushes the iron core to allow the linkage mechanism to be abutted against the regulation rod and allow the rotary knob to be abutted against the regulation rod.

14 Claims, 4 Drawing Sheets

(51) Int. Cl.
*H01H 71/24* (2006.01)
*H01H 71/34* (2006.01)

(58) Field of Classification Search
USPC ..... 335/15
See application file for complete search history.

(56) References Cited

U.S. PATENT DOCUMENTS 3,575,679 A * 4/1971 Ellsworth ..... H01H 71/7463 335/176
3,777,293 A * 12/1973 Tuzuki ..... H01H 71/2454 335/176
4,114,123 A * 9/1978 Grenier ..... H01H 71/7463 335/176
4,249,151 A * 2/1981 Esteves ..... H01H 71/7463 335/176
4,399,421 A * 8/1983 MacLean ..... H01H 83/20 335/174
4,503,408 A * 3/1985 Mrenna ..... H01H 71/40 335/35
4,691,182 A * 9/1987 Mrenna ..... H01H 71/7418 335/176
4,697,163 A * 9/1987 Grunert ..... H01H 71/44 335/174
4,713,639 A * 12/1987 Grunert ..... H01H 71/128 335/172
4,973,928 A * 11/1990 Grunert ..... H01H 71/7463 335/176
4,983,939 A * 1/1991 Shea ..... H01H 71/7463 335/42
5,467,069 A 11/1995 Payet-Burin et al. ..... 335/42
6,218,921 B1 * 4/2001 Eberts ..... H01H 71/322 335/172
6,667,675 B2 * 12/2003 Gibson ..... H01H 71/7463 335/171
6,930,575 B2 * 8/2005 Azzola ..... H01H 71/7463 335/42
2014/0054148 A1 * 2/2014 Marushima ..... H01H 33/40 200/400
2017/0133186 A1 * 5/2017 Ao ..... H01H 71/24

FOREIGN PATENT DOCUMENTS

CN 204946839 U 1/2016
CN 206022271 U 3/2017

OTHER PUBLICATIONS

Written Opinion dated Nov. 16, 2017 in corresponding PCT International Application No. PCT/CN2017/096757.

* cited by examiner

DIRECT-ACTING ELECTROMAGNETIC TRIP DEVICE

CROSS-REFERENCE TO RELATED APPLICATIONS

The present application is a 35 U.S.C. §§ 371 national phase conversion of PCT/CN2017/096757, filed Aug. 10, 2017, which claims priority to Chinese Patent Application No. 201610668166.X, filed Aug. 15, 2016, the contents of which are incorporated herein by reference. The PCT International Application was published in the Chinese language.

TECHNICAL FIELD

The present invention relates to the field of low-voltage apparatuses, in particular to a direct-acting electromagnetic trip device.

BACKGROUND ART

At present, in a circuit breaker with a regulate able instantaneous operating current, an electromagnetic trip device adopts a rotary regulation mode in which a regulation rod rotates to change the elongation of a tension spring connected thereto to change the reactive force of an electromagnetic suction force and the size of an air gap. This regulation mode needs many components, and usually requires a plurality of springs to be mounted, resulting in difficulty in mounting and complicated assembly process.

SUMMARY OF THE INVENTION

An objective of the present invention is to overcome the defects of the prior art and provide a direct-acting electromagnetic trip device which is simple and compact in structure, safe and stable in performance, and convenient to assemble.

To fulfill the said objective, the present invention adopts the following technical solution:

A direct-acting electromagnetic trip device comprises a housing, and a regulation mechanism 1, a linkage mechanism 2, an electromagnetic system 3 and a trip mechanism 4 which are arranged in the housing; the regulation mechanism 1 is connected with the linkage mechanism 2, the linkage mechanism 2 is connected with one end of an iron core 31 of the electromagnetic system 3, and the linkage mechanism 2 is connected with the trip mechanism 4 at the same time; when the electromagnetic system 4 has a tripping current inside, the iron core 31 of the electromagnetic system 3 actuates to drive the linkage mechanism 2, and the linkage mechanism 2 drives the trip mechanism 4 to complete a tripping action; the regulation mechanism 1 comprises a rotary knob 11 and a regulation rod 12, the rotary knob 11 is abutted against and engaged with the regulation rod 12, and the regulation rod 12 is abutted against and engaged with the linkage mechanism 2; the electromagnetic system 3 further comprises an elastic element 32, and the elastic element 32 pushes the iron core 31 to allow the linkage mechanism 2 to be abutted against the regulation rod 12 and allow the rotary knob 11 to be abutted against the regulation rod 12; the rotary knob 11 is rotated to trigger the regulation rod 12 to move upwards and downwards to drive the movement of the linkage mechanism 12, such that the linkage mechanism 2 drives the iron core 31 to move upwards and downward to regulate a tripping current of a product.

Further, the linkage mechanism 2 is located below the regulation mechanism 1, the electromagnetic system 3 is located below the linkage mechanism 2, and the trip mechanism 4 is located on one side of the linkage mechanism 2; the direct-acting electromagnetic trip device further comprises a support 5 and a fixed shaft 6, wherein the regulation rod 12 is mounted on the support 5 through the fixed shaft 6 and can move upwards and downwards along the fixed shaft 6; the regulation rod 12 is provided with an regulation rod fixing hole 1201 fitted to the fixed shaft 6; the support 5 is provided with a support fixing hole 501 corresponding to the regulation rod fixing hole 1201; the fixed shaft 6 passes through the regulation rod fixing hole 1201 and the support fixing hole 501 respectively to mount the regulation rod 12 on the support 5.

Further, the rotary knob 11 is disposed above the regulation rod 12; the rotary knob 11 is provided with a spiral surface 111 toward the regulation rod 12, and the regulation rod 12 is convexly provided with a protrusion 121 which is abutted against and engaged with the spiral surface 111; when the knob 11 is rotated, the spiral surface 111 can press the protrusion 121 of the regulation rod 12 downwards.

Further, the protrusion 121 comprises a cylindrical protrusion 1211 at the lower end and a conical protrusion 1212 provided on the cylindrical protrusion 1211 wherein the top tip of the conical protrusion 1212 is abutted against and rotatably engaged with the spiral surface 11.

Further, a rotary plane of the rotary knob 11 is perpendicular to a movement direction of the regulation rod 12; one end of the spiral surface 111 is protrudes and is provided with a stop 1110 for limiting the displacement of the protrusion 121.

Further, the rotary knob 11 comprises a circular rotating portion 11*a* at the upper end and a circular connection portion 11*b* at the lower end, wherein the spiral surface 111 is disposed on the lower surface of the rotation portion 11*a*, the rotation portion 11*a* and the connection portion 11*b* are connected by a connection portion 11*c*, and the outer sidewall of the rotation portion 11*a* is provided with a threaded surface 110*a* for facilitating the rotation of the rotary knob 11.

Further, the regulation rod 12 is located above the linkage mechanism 2; the regulation rod 12 protrudes towards the linkage mechanism 2 and is respectively provided with pressing rods 122 that are abutted against and engaged with all levels of linkage rods 21 of the linkage mechanism 2 each other, wherein each level of linkage rod 21 corresponds to one level of electromagnetic system 3 and is provided with an abutting protrusion 2103 that is abutted against and engaged with the pressing rod 122 each other.

Further, the trip mechanism 4 comprises a drawbar 41 that is pivotally connected inside the housing; the drawbar 41 is located on one side of the linkage rod 21 and is disposed in parallel with the linkage rod 21; the drawbar 41 extends toward one side of the linkage rod 21 and is provided with an extension rod 411; the linkage rod 21 is provided with a connection rod 2102 that is in linkage and engaged with the extension rod 411.

Further, one end of the linkage rod 21 is fixedly connected with one end of the iron core 31; one end of the iron core 31 is provided with a T-shaped fixed end 3101; the sidewall of the linkage rod 21 is provided with a T-shaped fixing groove 2101 that is in mounting fit with the T-shaped fixed end 3101; the T-shaped fixed end 3101 of the iron core 31 is fixed in the T-shaped fixing groove 2101 from one side of the linkage rod 21; the T-shaped fixed end 3101 comprises a lateral fixed end 31011 and a longitudinal fixed end 31012 vertically connected to the middle of the lateral fixed end 31011; the T-shaped fixing groove 2101 comprises a lateral fixing groove 21011 corresponding to the lateral fixed end 31011 and a longitudinal fixing groove 21012 corresponding to the longitudinal fixed end 31012.

Further, the linkage rod 21 is square; the abutting protrusion 2103 protrudes and is disposed on one side of the linkage rod 21; a cavity 201 is formed in the middle of the linkage rod 21; a connection rod 2102 is formed on the upper side of the cavity 201 of the linkage rod 21; the abutting protrusion 2103 divides the cavity 201 into a first cavity 201*a* and a second cavity 201*b*, the second cavity 201*b* is in linkage and engaged with the extension rod 411.

Further, the trip mechanism 4 comprises a drawbar 41, a buckle 42 protruding from one side of the drawbar 41, and a jump pin 43 pivotally connected into the housing; the buckle 42 and the jump pin 43 are snap-connected; the linkage mechanism 2 can drive the drawbar 41 to rotate, so that the buckle 42 and the jump pin 43 are unfastened, and a circuit is cut off.

Further, the elastic element is a compression spring; the electromagnetic system 3 further comprises a solenoid 301, an electromagnetic coil wound around the solenoid 301, and a first armature 33, a second armature 34 and a third armature 35 which are coaxially mounted in a mounting cavity 302 in the middle of the solenoid 301; the first armature 33 is fixedly disposed on the top of the solenoid 301, the third armature 35 is disposed at the bottom of the solenoid 301, and the second armature 34 is located between the first armature 33 and the third armature 35; the lower end of the second armature 34 is connected with one end of the elastic element 32, and the other end of the elastic element 32 is connected with the third armature 35; the other end of the iron core 31 is connected with the upper end of the second armature 34 after passing through the first armature 33; a first air gap length L1 is formed between the first armature 33 and the second armature 34, and a second air gap length L2 is formed between the second armature 34 and the third armature 35; the regulation mechanism 1 drives the iron core 31 to move upwards and downward, such that the second armature 34 moves upwards and downwards under the action of the iron core 31 and the elastic element 32 to regulate the first air gap length L1 and the second air gap length L2 so as to regulate the tripping current of the product.

Further, the upper end of the second armature 34 is provided with a first groove 3401, and the other end of the iron core 31 extends into the first groove 3401 to abut against the bottom of the first groove 3401; the lower end of the second armature 34 is provided with a second groove 3402 connected with one end of the elastic element 32, and the upper end of the third armature 35 is provided with a third groove 3501 connected with the other end of the elastic element 32.

Further, the top end of the solenoid 301 protrudes towards the inside of the solenoid 301 and is provided with a limiting protrusion 3011 for limiting an upward displacement distance of the second armature 34; when the second armature 34 is abutted against and limited by the limiting protrusion 3011, a first air gap length L1 is reserved between the first armature 33 and the second armature 34.

According to the direct-acting electromagnetic trip device of the present invention, the rotary knob and the regulation rod are arranged, such that the rotary knob is rotated to trigger the regulation rod to move upwards and downwards, thereby driving the linkage mechanism to actuate. The linkage mechanism drives the iron core to move upwards and downwards to regulate the tripping current of the product. The direct-acting electromagnetic trip device of the present invention is simple in structure, convenient to assemble, and low in cost. The regulation mechanism, the linkage mechanism and the electromagnetic system are vertically distributed in sequence; the trip mechanism is located on one side of the linkage mechanism; a fixing shaft passes through the regulation rod fixing hole and the support fixing hole respectively to mount the regulation rod on the support, and the regulation rod can move upwards and downwards along the fixing shaft. Therefore, the regulation rod can move upwards and downwards by rotating the rotary knob. When the rotary knob is rotated, the protrusion of the regulation rod rotates along the spiral surface of the rotary knob, and the spiral surface gradually presses the protrusion downwards, such that the regulation rod moves upwards and downwards. The protrusion is rotatably engaged with the spiral surface through the top tip of the conical protrusion, such that a sliding friction force between the protrusion and the spiral surface can be reduced, and therefore the rotary knob can be rotated with a smoother hand feel. The overall structure of the electromagnetic system is simple and compact. The regulation mechanism regulates the tripping current of the product by regulating the first air gap length L1 and the second air gap length L2.

DETAILED DESCRIPTIONS OF THE PREFERRED EMBODIMENTS

The specific embodiments of a direct-acting electromagnetic trip device of the present invention will be further described below with reference to the embodiments provided in FIGS. 1 to 7. The direct-acting electromagnetic trip device of the present invention is not limited to the description of the following embodiments.

Figure 1:
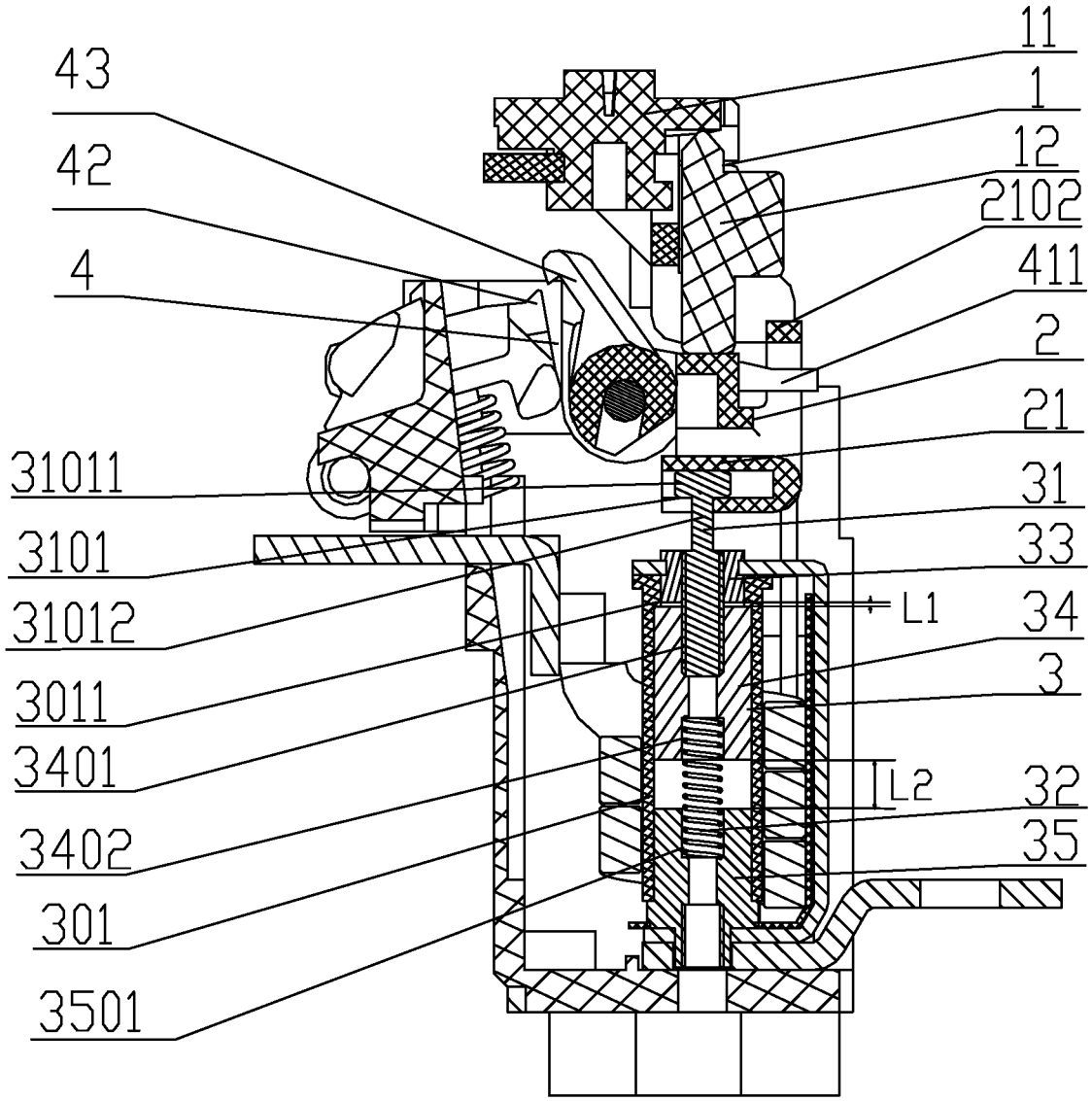
FIG. 1 is a sectional view of a direct-acting electromagnetic trip device of the present invention.
Figure 2:
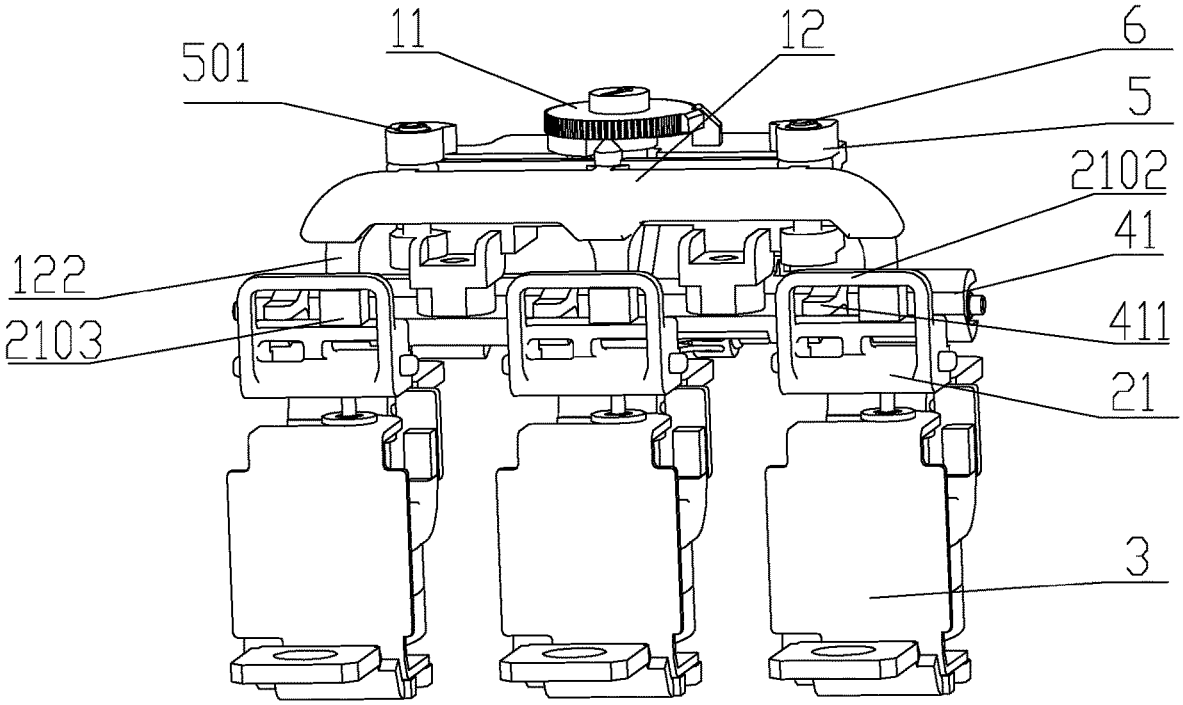
FIG. 2 is a stereoscopic structural schematic diagram of the direct-acting electromagnetic trip device of the present invention.
Figure 3:
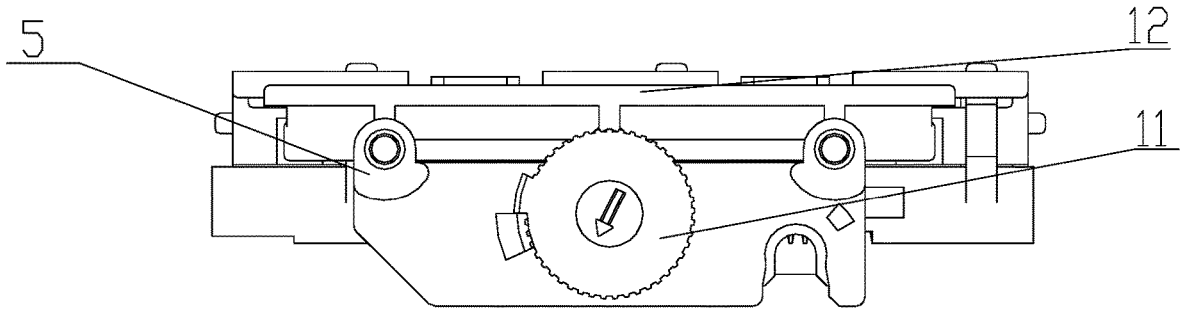
FIG. 3 is a top view of the direct-acting electromagnetic trip device of the present invention.

As shown in FIGS. 1 and 2, the direct-acting electromagnetic trip device of the present invention comprises a housing, and a regulation mechanism 1, a linkage mechanism 2, an electromagnetic system 3 and a trip mechanism 4 which are arranged in the housing. The linkage mechanism 2 is located below the regulation mechanism 1, the electromagnetic system 3 is located below the linkage mechanism 2, and the trip mechanism 4 is located on one side of the linkage mechanism 2. The regulation mechanism 1 is connected with the linkage mechanism 2, the linkage mechanism 2 is connected with one end of an iron core 31 of the electromagnetic system 3, and the linkage mechanism 2 is connected with the trip mechanism 4 at the same time. When the electromagnetic system 4 has a tripping current inside, the iron core 31 of the electromagnetic system 3 actuates to drive the linkage mechanism 2, and the linkage mechanism 2 drives the trip mechanism 4 to complete a tripping action. According to the present invention, the regulation mechanism 1, the linkage mechanism 2 and the electromagnetic system 3 are vertical distributed in sequence, and the trip mechanism 4 is located on one side of the linkage mechanism 2, such that the overall layout is simple and compact.

The embodiment of the present invention has three levels of electromagnetic systems 3, and the linkage mechanism 2 is provided with three linkage rods 21 respectively corresponding to the three levels of electromagnetic systems 3. It is obvious that the direct-acting electromagnetic trip device of the present invention may be provided with multiple levels of electromagnetic systems.

As shown in FIGS. 1 and 2, the elastic element 32 is a compression spring. The electromagnetic system 3 further comprises a solenoid 301, an electromagnetic coil wound around the solenoid 301, and a first armature 33, a second armature 34 and a third armature 35 which are coaxially disposed in a mounting cavity 302 in the middle of the solenoid 301. The first armature 33 is fixedly disposed on the top of the solenoid 301, the third armature 35 is disposed at the bottom of the solenoid 301, and the second armature 34 is located between the first armature 33 and the third armature 35. The lower end of the second armature 34 is connected with one end of the elastic element 32, and the other end of the elastic element 32 is connected with the third armature 35; the other end of the iron core 31 is connected with the upper end of the second armature 34 after passing through the first armature 33; a first air gap length L1 is formed between the first armature 33 and the second armature 34, and a second air gap length L2 is formed between the second armature 34 and the third armature 35.

As shown in FIGS. 1 and 2, the trip mechanism 4 comprises a drawbar 41, a buckle 42 protruding from one side of the drawbar 41, and a jump pin 43 pivotally connected to the housing. The buckle 42 and the jump pin 43 are snap-connected. The drawbar 41 is pivotally connected inside the housing. The drawbar 41 is located on one side of the linkage rod 21 and is disposed in parallel with the linkage rod 21. The drawbar 41 extends toward one side of the linkage rod 21 and is provided with an extension rod 411. The linkage rod 21 is provided with a connection rod 2102 that is in linkage and engaged with the extension rod 411. The connection rod 2102 of the linkage rod 21 is in linkage and engaged with the extension rod 411 of the drawbar 41. The connection rod 2102 of the linkage rod 21 can press the extension rod 411 downwards to drive the drawbar 41 to rotate, and the trip mechanism 4 actuates to cut off a circuit. The linkage mechanism 2 can drive the drawbar 41 to rotate, so that the buckle 42 and the jump pin 43 are unfastened, and the circuit is cut off.

As shown in FIGS. 1 and 2, the regulation mechanism 1 of the present invention drives the iron core 31 to move upwards and downwards, such that the second armature 34 moves upwards and downwards under the action of the iron core 31 and the elastic element 32 to regulate the first air gap length L1 and the second air gap length L2 so as to regulate the tripping current of the product. The overall structure of the electromagnetic system 3 is simple and compact. The regulation mechanism 1 regulates the tripping current of the product by regulating the first air gap length L1 and the second air gap length L2.

As shown in FIGS. 1 to 5, the regulation mechanism 1 comprises a rotary knob 11 and a regulation rod 12, wherein the rotary knob 11 is abutted against and engaged with the regulation rod 12, and the regulation rod 12 is abutted against and engaged with the linkage mechanism 2. The electromagnetic system 3 further comprises an elastic element 32, and the elastic element 32 pushes the iron core 31 to allow the linkage mechanism 2 to be abutted against the regulation rod 12 and allow the rotary knob 11 to be abutted against the regulation rod 12. The rotary knob 11 is rotated to trigger the regulation rod 12 to move upwards and downwards to drive the movement of the linkage mechanism 12, such that the linkage mechanism 2 drives the iron core 31 to move upwards and downwards to regulate the tripping current of the product. According to the direct-acting electromagnetic trip device of the present invention, the rotary knob and the regulation rod are arranged, such that the rotary knob is rotated to trigger the regulation rod to move upwards and downwards, thereby driving the linkage mechanism to actuate. The linkage mechanism drives the iron core to move upwards and downwards to regulate the tripping current of the product. The direct-acting electromagnetic trip device of the present invention is simple in structure, convenient to assemble, and low in cost.

Figure 5:
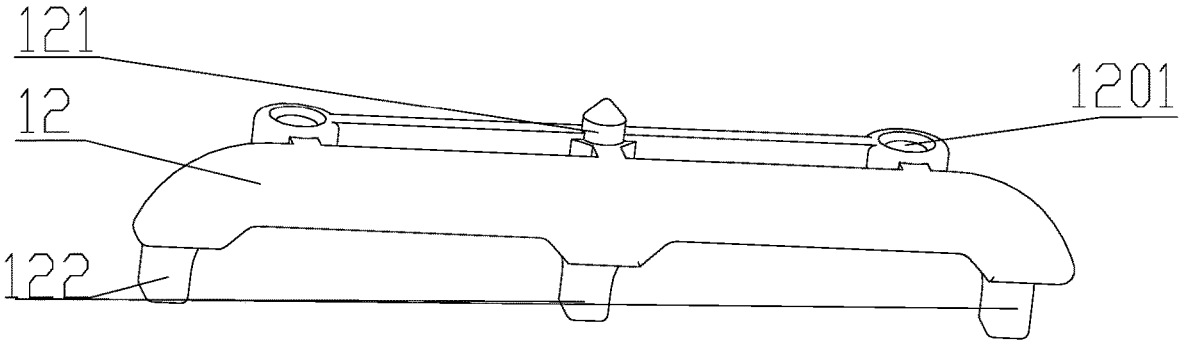
FIG. 5 is a stereoscopic structural schematic diagram of a regulation rod of the present invention.
Figure 6:
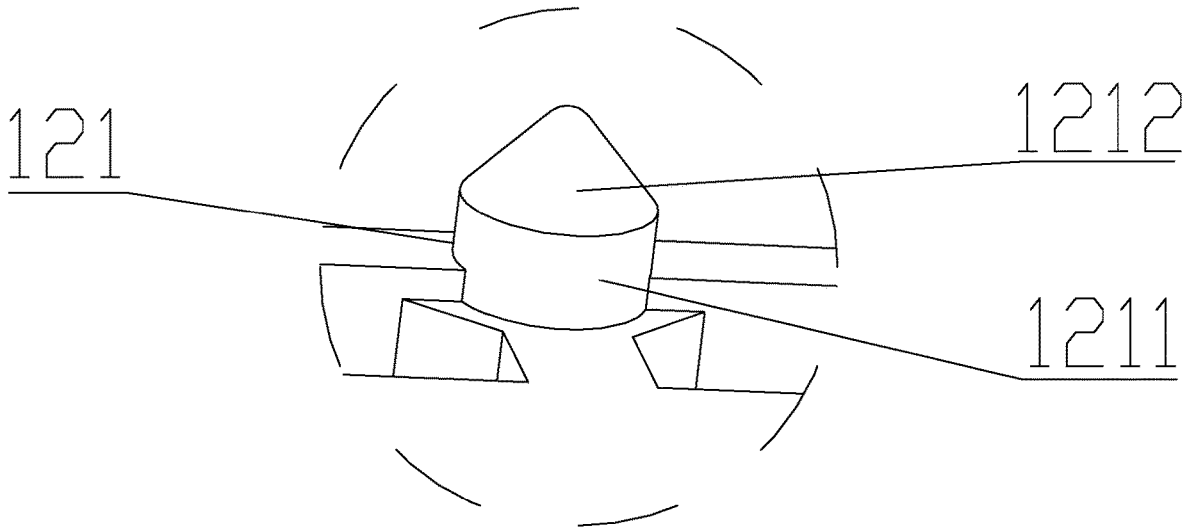
FIG. 6 is an enlarged structural schematic diagram of a protrusion of the present invention.

As shown in FIGS. 1, 2 and 5, the direct-acting electromagnetic trip device further comprises a support 5 and a fixed shaft 6, wherein the regulation rod 12 is mounted on the support 5 through the fixed shaft 6 and can move up and down along the fixed shaft 6. The regulation rod 12 is provided with an regulation rod fixing hole 1201 fitted to the fixed shaft 6. The support 5 is provided with a support fixing hole 501 corresponding to the regulation rod fixing hole 1201. The fixed shaft 6 passes through the regulation rod fixing hole 1201 and the support fixing hole 501 respectively to mount the regulation rod 12 on the support 5, and the regulation rod 12 can move up and down along the fixed shaft 6. The regulation rod 12 can move upwards and downwards by rotating the rotary knob 11. The fixed shaft 6 may also be integrated with the support 5.

As shown in FIGS. 1 to 5, the rotary knob 11 is disposed above the regulation rod 12. A rotary plane of the rotary knob 11 is perpendicular to a movement direction of the regulation rod 12. The rotary knob 11 is provided with a spiral surface 111 toward the regulation rod 12, and the regulation rod 12 protrudes upwards and is provided with a protrusion 121 which is abutted against and engaged with the spiral surface 111. When the rotary knoll is rotated, the spiral surface 111 can press the protrusion 121 of the regulation rod 12 downwards. When the rotary knob is rotated, the protrusion 121 of the regulation rod 12 rotates along the spiral surface 111 of the rotary knob 11, and the spiral surface 111 gradually presses the protrusion 121 downwards, such that the regulation rod 121 moves downwards. The protrusion 121 comprises a cylindrical protrusion 1211 at the lower end and a conical protrusion 1212 provided on the cylindrical protrusion 1211, wherein the top tip of the conical protrusion 1212 is abutted against and rotatably engaged with the spiral surface 11. The protrusion 121 is rotatably engaged with the spiral surface 111 through the top tip of the conical protrusion 1212, such that a sliding friction force between the protrusion 121 and the spiral surface 111 can be reduced, and therefore the rotary knob 11 can be rotated with a smoother hand feel. The protrusions 121 can also be provided in other shapes, such as pyramids or other combined structures. A groove-shaped track that allows the tip of the protrusion 121 to move can also be machined under the spiral surface 111, so that the linkage structure of the rotary knob 11 and the adjustment rod 12 can be made more stable. One end of the spiral surface 111 protrudes and is provided with a stop 1110 for limiting the displacement of the protrusion 121. The protrusion 121 is limited by the stop 1110 to limit the rotation amplitude of the rotary knob 11.

Figure 4:
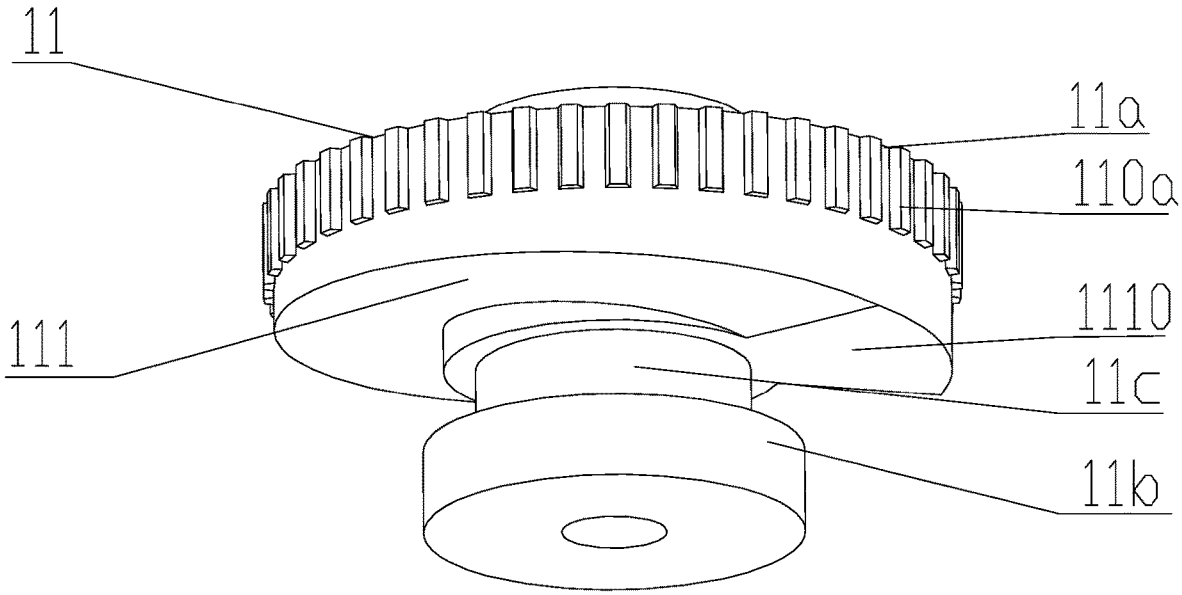
FIG. 4 is a stereoscopic structural schematic diagram of a rotary knob of the present invention.

FIG. 4 illustrates a specific structure of the rotary knob 11 of the present invention. The rotary knob 11 comprises a circular rotating portion 11*a* at the upper end and a circular connection portion 11*b* at the lower end, wherein the spiral surface 111 is disposed on the lower surface of the rotation portion 11*a*, the rotation portion 11*a* and the connection portion 11*b* are connected by a connection portion 11*c*, and the outer sidewall of the rotation portion 11*a* is provided with a threaded surface 110*a* for facilitating the rotation of the rotary knob 11.

FIG. 5 illustrates a specific structure of the adjustment rod 12. The regulation rod 12 is in a shape of a long stick as a whole. The regulation rod 12 is located above the linkage mechanism 2. The regulation rod 12 protrudes towards the linkage mechanism 2 and is respectively provided with pressing rods 122 that is abutted against and engaged with all levels of linkage rods 21 of the linkage mechanism 2 each other, wherein each level of linkage rod 21 corresponds to one level of electromagnetic system 3 and is provided with an abutting protrusion 2103 that is abutted against and engaged with the pressing rod 122 each other. The pressing rod of the regulation rod 12 is abutted against and engaged with the abutting protrusion 2103 of the linkage rod 21 each other, such that the structure is more stable.

Figure 7:
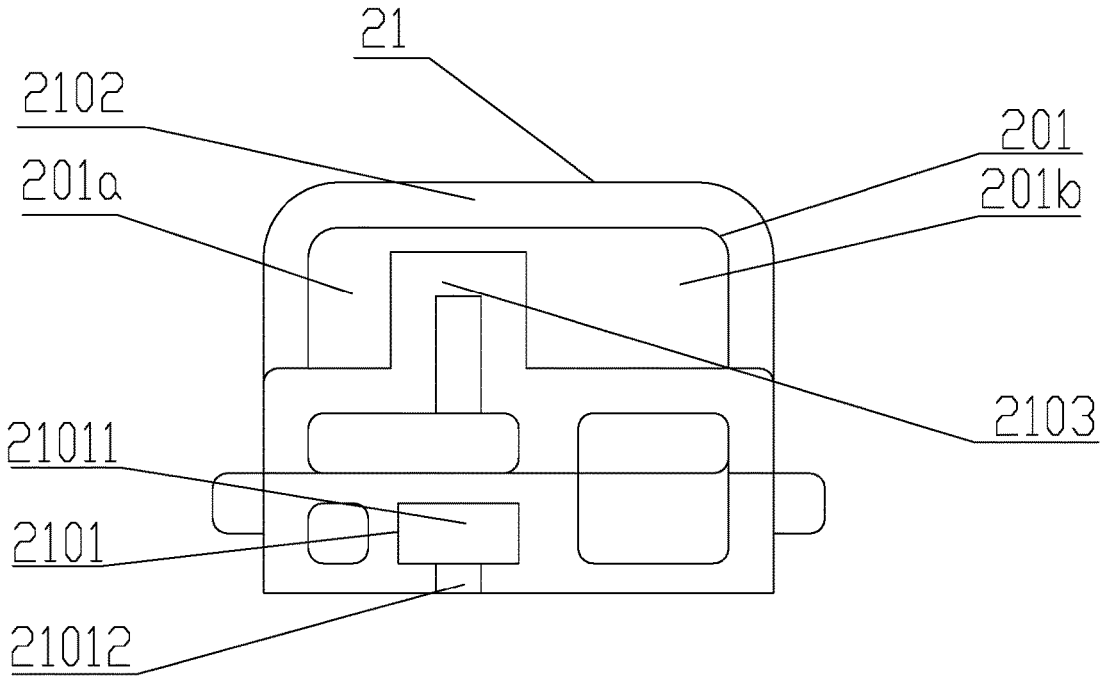
FIG. 7 is a structural schematic diagram of a linkage rod of the present invention.

FIG. 7 illustrates a specific structure of the linkage rod 21. The linkage rod 21 is square; the abutting protrusion 2103 is convexly disposed on one side of the linkage rod 21; a cavity 201 is formed in the middle of the linkage rod 21; a connection rod 2102 is formed on the upper side of the cavity 201 of the linkage rod 21; the abutting protrusion 2103 divides the cavity 201 into a first cavity 201*a* and a second cavity 201*b* that is in linkage and engaged with the extension rod 411. Specifically, one end of the linkage rod 21 is fixedly connected with one end of the iron core 31; one end of the iron core 31 is provided with a T-shaped fixed end 3101; the sidewall of the linkage rod 21 is provided with a T-shaped fixing groove 2101 that is in mounting fit with the T-shaped fixed end 3101; the T-shaped fixed end 3101 of the iron core 31 is fixed in the T-shaped fixing groove 2101 from one side of the linkage rod 21; the T-shaped fixed end 3101 comprises a lateral fixed end 31011 and a longitudinal fixed end 31012 vertically connected to the middle of the lateral fixed end 31011; the T-shaped fixing groove 2101 comprises a lateral fixing groove 21011 corresponding to the lateral fixed end 31011 and a longitudinal fixing groove 21012 corresponding to the longitudinal fixed end 31012. The T-shaped fixed end 3101 at one end of the iron core 31 is mounted into the T-shaped fixing groove 2101 on the sidewall of the linkage rod 21 from the side surface of the linkage rod 21, such that the mounting structure is stable and reliable.

Specifically, as shown in FIGS. 1 and 2, the upper end of the second armature 34 of the electromagnetic system 3 of the present invention is provided with a first groove 3401, and the other end of the iron core 31 extends into the first groove 3401 to abut against the bottom of the first groove 3401; the lower end of the second armature 34 is provided with a second groove 3402 connected with one end of the elastic element 32, and the upper end of the third armature 35 is provided with a third groove 3501 connected with the other end of the elastic element 32. The other end of the iron core 31 extends into the first groove 3401 to abut against the bottom of the first groove 3401. Two ends of the compression spring are fixed by the second groove 3402 and the third groove 3501 respectively, such that the overall structure is stable and reliable. Specifically, the first armature 33, the second armature 34 and the third armature 35 are of a hollow structure respectively. Specifically, the top end of the solenoid 301 protrudes towards the inside of the solenoid 301 and is provided with a limiting protrusion 3011 for limiting an upward displacement distance of the second armature 34; when the second armature 34 is abutted against and limited by the limiting protrusion 3011, a first air gap length L1 is reserved between the first armature 33 and the second armature 34. The limiting protrusion 3011 is used to limit the position at which the second armature 34 moves upwards.

When mounting, the electromagnetic system 3 of the direct-acting electromagnetic trip device of the present invention is mounted first, and then the iron core 31 of the electromagnetic system 3 and the linkage rod 21 of the linkage mechanism 2 are mounted and fixed; the support 5, the drawbar 41 and the jump pin 43 are pivotally connected in the housing in sequence, the adjustment rod 12 is mounted on the support 5, and the buckle 42 and the rotary knob 11 are mounted on the housing.

Next, the working principle of the direct-acting electromagnetic trip device of the present invention will be described.

When the product is working normally, the buckle 42 of the trip mechanism 4 and the jump pin 43 are snap-connected. When there is a tripping current in the circuit, the electromagnetic coil of the electromagnetic system 1 generates an electromagnetic force to pull the iron core 31 downwards; the iron core 31 drives the linkage rod 21 of the linkage mechanism 2 to move downwards; the connection rod 2102 of the linkage rod 21 drives the extension rod 411 to rotate the drawbar 41; the buckle 42 and the jump pin 43 are unfastened, and the circuit is cut off.

The above content is a further detailed description of the present invention in connection with the specific preferred embodiments, and the specific embodiments of the present invention are not limited to these descriptions. It will be apparent to those skilled in the art that the present invention may be subject to several simple deductions or displacements without departing from the concept of the present invention. These simple deductions or displacements should be considered as falling into the protection scope of the present invention.

The invention claimed is:

1. A direct-acting electromagnetic trip device, comprising a housing, and a regulation mechanism, a linkage mechanism, an electromagnetic system and a trip mechanism which are arranged in the housing, wherein:

the regulation mechanism is connected with the linkage mechanism, the linkage mechanism is connected with one end of an iron core of the electromagnetic system, and the linkage mechanism is connected with the trip mechanism at the same time;

when the electromagnetic system has a tripping current inside, the iron core of the electromagnetic system actuates to drive the linkage mechanism, and the linkage mechanism drives the trip mechanism to complete a tripping action;

the regulation mechanism comprises a rotary knob and a regulation rod, wherein the rotary knob is abutted against and engaged with the regulation rod, and the regulation rod is abutted against and engaged with the linkage mechanism;

the electromagnetic system further comprises an elastic element, and the elastic element pushes the iron core to allow the linkage mechanism to be abutted against the regulation rod and allow the rotary knob to be abutted against the regulation rod; and the rotary knob is rotated to trigger the regulation rod to move upwards and downwards to drive the movement of the linkage mechanism, such that the linkage mechanism drives the iron core to move upwards and downwards to regulate a tripping current of a product, wherein the linkage mechanism is located below the regulation mechanism, the electromagnetic system is located below the linkage mechanism, and the trip mechanism is located on one side of the linkage mechanism;

wherein the direct-acting electromagnetic trip device further comprises a support and a fixed shaft, and wherein the regulation rod is mounted on the support through the fixed shaft and can move upwards and downwards along the fixed shaft.

2. The direct-acting electromagnetic trip device according to claim 1, wherein:

the regulation rod is provided with a regulation rod fixing hole fitted to the fixed shaft;

the support is provided with a support fixing hole corresponding to the regulation rod fixing hole; and the fixed shaft passes through the regulation rod fixing hole and the support fixing hole respectively to mount the regulation rod on the support.

3. The direct-acting electromagnetic tripping device according to claim 1, wherein:

the rotary knob is disposed above the regulation rod;

the rotary knob is provided with a spiral surface toward the regulation rod, and the regulation rod protrudes upwards and is provided with a protrusion which is abutted against and engaged with the spiral surface; and when the knob is rotated, the spiral surface can press the protrusion of the regulation rod downwards.

4. The direct-acting electromagnetic trip device according to claim 3, wherein the protrusion comprises a cylindrical protrusion at the lower end and a conical protrusion provided on the cylindrical protrusion, and the top tip of the conical protrusion is abutted against and rotatably engaged with the spiral surface.

5. The direct-acting electromagnetic trip device according to claim 3, wherein:

a rotary plane of the rotary knob is perpendicular to a movement direction of the regulation rod; and one end of the spiral surface protrudes and is provided with a stop for limiting the displacement of the protrusion.

6. The direct-acting electromagnetic trip device according to claim 3, wherein the rotary knob comprises a circular rotating portion at the upper end and a circular connection portion at the lower end, wherein the spiral surface is disposed on the lower surface of the rotation portion, the rotation portion and the connection portion are connected by a connection portion, and the outer sidewall of the rotation portion is provided with a threaded surface for facilitating the rotation of the rotary knob.

7. The direct-acting electromagnetic trip device according to claim 1, wherein:

the regulation rod is located above the linkage mechanism; and the regulation rod protrudes towards the linkage mechanism and is respectively provided with pressing rods that are abutted against and engaged with all levels of linkage rods of the linkage mechanism each other, wherein each level of linkage rod corresponds to one level of electromagnetic system and is provided with an abutting protrusion that is abutted against and engaged with the pressing rod each other.

8. The direct-acting electromagnetic trip device according to claim 7, wherein:

the trip mechanism comprises a drawbar that is pivotally connected inside the housing;

the drawbar is located on one side of the linkage rod and is disposed in parallel with the linkage rod;

the drawbar extends toward one side of the linkage rod and is provided with an extension rod; and the linkage rod is provided with a connection rod that is in linkage and engaged with the extension rod.

9. The direct-acting electromagnetic trip device according to claim 7, wherein:

one end of the linkage rod is fixedly connected with one end of the iron core;

one end of the iron core is provided with a T-shaped fixed end;

the sidewall of the linkage rod is provided with a T-shaped fixing groove that is in mounting fit with the T-shaped fixed end;

the T-shaped fixed end of the iron core is fixed in the T-shaped fixing groove from one side of the linkage rod;

the T-shaped fixed end comprises a lateral fixed end and a longitudinal fixed end vertically connected to the middle of the lateral fixed end; and the T-shaped fixing groove comprises a lateral fixing groove corresponding to the lateral fixed end and a longitudinal fixing groove corresponding to the longitudinal fixed end.

10. The direct-acting electromagnetic trip device according to claim 7, wherein:

the linkage rod is square;

the abutting protrusion is convexly disposed on one side of the linkage rod;

a cavity is formed in the middle of the linkage rod;

a connection rod is formed on the upper side of the cavity of the linkage rod; and the abutting protrusion divides the cavity into a first cavity and a second cavity, the second cavity is in linkage and engaged with the extension rod.

11. The direct-acting electromagnetic trip device according to claim 1, wherein:

the trip mechanism comprises a drawbar, a buckle protruding from one side of the drawbar, and a jump pin pivotally connected to the housing;

the buckle and the jump pin are snap-connected; and the linkage mechanism can drive the drawbar to rotate, so that the buckle and the jump pin are unfastened, and a circuit is cut off.

12. The direct-acting electromagnetic trip device according to claim 1, wherein:

the elastic element is a compression spring;

the electromagnetic system further comprises a solenoid, an electromagnetic coil wound around the solenoid, and a first armature, a second armature and a third armature which are coaxially disposed in a mounting cavity in the middle of the solenoid;

the first armature is fixedly disposed on the top of the solenoid, the third armature is disposed at the bottom of the solenoid, and the second armature is located between the first armature and the third armature;

the lower end of the second armature is connected with one end of the elastic element, and the other end of the elastic element is connected with the third armature;

the other end of the iron core is connected with the upper end of the second armature after passing through the first armature;

a first air gap length is formed between the first armature and the second armature, and a second air gap length is formed between the second armature and the third armature; and the regulation mechanism drives the iron core to move upwards and downward, such that the second armature moves upwards and downwards under the action of the iron core and the elastic element to regulate the first air gap length and the second air gap length so as to regulate the tripping current of the product.

13. The direct-acting electromagnetic trip device according to claim 12, wherein:

the upper end of the second armature is provided with a first groove, and the other end of the iron core extends into the first groove to abut against the bottom of the first groove; and the lower end of the second armature is provided with a second groove connected with one end of the elastic element, and the upper end of the third armature is provided with a third groove connected with the other end of the elastic element.

14. The direct-acting electromagnetic trip device according to claim 12, wherein:

the top end of the solenoid protrudes towards the inside of the solenoid and is provided with a limiting protrusion for limiting an upward displacement distance of the second armature; and when the second armature is abutted against and limited by the limiting protrusion, a first air gap length is reserved between the first armature and the second armature.

* * * * *